US011926962B2

(12) United States Patent
Bartelmuss

(10) Patent No.: US 11,926,962 B2
(45) Date of Patent: Mar. 12, 2024

(54) SCRAPER BAR FOR USE IN A PLANT FOR PRODUCING A PAPER WEB AND PLANT HAVING THE SCRAPER BAR

(71) Applicant: Klaus Bartelmuss, Teufenbach (AT)

(72) Inventor: Klaus Bartelmuss, Teufenbach (AT)

( * ) Notice: Subject to any disclaimer, the term of this patent is extended or adjusted under 35 U.S.C. 154(b) by 0 days.

(21) Appl. No.: 17/832,768

(22) Filed: Jun. 6, 2022

(65) Prior Publication Data

US 2022/0389655 A1 Dec. 8, 2022

(30) Foreign Application Priority Data

Jun. 8, 2021 (AT) ..... A 50464/2021

(51) Int. Cl.
*D21F 1/48* (2006.01)
*D21F 3/02* (2006.01)

(52) U.S. Cl.
CPC ..... *D21F 1/483* (2013.01); *D21F 3/029* (2013.01)

(58) Field of Classification Search
CPC ..... D21F 1/483; D21F 3/029; D21F 1/486
See application file for complete search history.

(56) References Cited

U.S. PATENT DOCUMENTS 5,076,894 A * 12/1991 Simmons ..... D21F 1/523 162/374
7,198,697 B2 4/2007 Bartelmuss et al.
8,152,969 B2 4/2012 Bartelmuss et al.
2008/0087398 A1* 4/2008 Bartelmuss ..... D21F 1/483 162/352

FOREIGN PATENT DOCUMENTS

| | | | | |
|---|---|---|---|---|
| CN | 101165268 A | | 4/2008 | |
| DE | 3306457 A | * | 8/1984 | ..... D21F 1/483 |
| DE | 3306457 A1 | | 8/1984 | |
| DE | 4319311 A1 | | 12/1994 | |
| DE | 69119295 T2 | | 9/1996 | |
| EP | 0454973 A1 | | 11/1991 | |
| JP | S60500819 A | | 5/1985 | |
| JP | H10195790 A | | 7/1998 | |
| JP | 2004353156 A | | 12/2004 | |
| WO | 8403314 A1 | | 8/1984 | |

* cited by examiner

*Primary Examiner* — Eric Hug
*Assistant Examiner* — Matthew M Eslami
(74) *Attorney, Agent, or Firm* — Laurence A. Greenberg; Werner H. Stemer; Ralph E. Locher

(57) ABSTRACT

A scraper bar is used in a plant for producing a paper web with a sieve belt. The sieve belt is movable over the scraper bar transversely with respect to the longitudinal extent of the scraper bar. The scraper bar has wearing elements which face toward the sieve belt, are mounted on a supporting bar and are arranged one after the other in the direction of the longitudinal extent of the scraper bar. The supporting bar has supporting bar elements which are arranged one after the other in the longitudinal extent and which are preferably connected to one another and on which the wearing elements are fastened.

17 Claims, 4 Drawing Sheets

SCRAPER BAR FOR USE IN A PLANT FOR PRODUCING A PAPER WEB AND PLANT HAVING THE SCRAPER BAR

CROSS-REFERENCE TO RELATED APPLICATION

This application claims the priority, under 35 U.S.C. § 119, of Austrian Patent Application A 50464/2021, filed Jun. 8, 2021; the prior application is herewith incorporated by reference in its entirety.

FIELD AND BACKGROUND OF THE INVENTION

The present invention relates to a scraper bar for use in a plant for producing a paper web with a sieve belt. The scraper bar has a longitudinal extent and the sieve belt is movable over the scraper bar transversely with respect to the longitudinal extent. The scraper bar has wearing elements which face toward the sieve belt, which are mounted on a supporting bar and which are arranged one after the other in the direction of the longitudinal extent of the scraper bar.

The present invention furthermore relates to a kit for use in a plant for producing a paper web and to a plant for producing a paper web.

Known plants for producing a paper web have an intrinsically closed sieve belt, which is moved in a circulating manner by means of conveyor rolls and onto which a fibrous stock is sprayed at the beginning of the plant. In a first region of the plant, the sieve belt is moved over scraper bars and over suction boxes formed with scraper bars, by which liquid that has emerged from the fibrous stock is scraped off and suctioned away. In further regions of the plant, the paper web produced on the sieve belt is dried by use of felt belts.

The scraper bars located in such a plant, which are oriented transversely with respect to the movement direction of the sieve belt, are bars produced from metal or from plastic which have, on their top side facing toward the sieve belt in the operating position, a support or wearing elements made of a wear-resistant material, in particular made of surface-ground ceramic plates. Ceramic plates of this kind consist in particular of Al oxide, of Zr oxide, of Si nitride and of Si carbide. The sieve belt is moved over the scraper bars at a speed of 1 m/sec to 40 m/sec. The wearing elements are worn due to the friction between the scraper bars and the sieve belt.

It is therefore necessary to replace the scraper bars at regular time intervals. All of the commercially available scraper bars with in particular ceramic wearing elements, which may have lengths of up to 12 m, are of one-part form and are adapted exactly to the respective width of the paper machine. They therefore have to be produced individually. This individual construction has the disadvantage that it is expensive, requires long delivery times and it is not possible to make to stock.

SUMMARY OF THE INVENTION

The present invention is therefore based on the object of providing a scraper bar which can be individually adapted to desired lengths.

With the foregoing and other objects in view there is provided, in accordance with the invention, a scraper bar for use in a plant for producing a paper web with a sieve belt. The scraper bar contains a scrapper body having a longitudinal extent and the sieve belt is movable over the scraper body transversely with respect to the longitudinal extent. The scrapper body has a supporting bar and wearing elements facing toward the sieve belt and mounted on the supporting bar and the wearing elements are disposed one after another in a direction of the longitudinal extent of the scraper body. The supporting bar has supporting bar elements disposed one after another in the direction of the longitudinal extent and are connected to one another and on the support bar elements the wearing elements are fastened.

The dependent claims provide preferred embodiments of the invention.

The scraper bar according to the invention has supporting bar elements, which may have a length of, for example, 0.5 m, 1 m or 2 m. According to the invention, it is of course also possible to produce supporting bar elements having any desired lengths between the indicated lengths, and also shorter or longer supporting bar elements. It is thus possible for modular parts of various lengths to be prefabricated, from which scraper bars of substantially any desired length may be produced. A scraper bar having a total length of e.g. 8.5 m may be produced, for example, from four supporting bar elements having a length of 2 m and one supporting bar element of 0.5 m.

As seen in the longitudinal extent of the supporting bar, one, two or more than two wearing elements are fastened in each case on the supporting bar elements.

The supporting bar elements produced as modular parts with in each case one or more wearing elements can be produced in an automated manner. In this way, this production step is no longer directly order-related and can be largely automated in a dedicated production line. These modular parts can be made to stock and a scraper bar can be assembled from a plurality of these parts for a customer without delay.

In order to ensure correct positioning of the individual supporting bar elements against one another, in a preferred embodiment of the invention the supporting bar elements have end faces at which they bear against adjacent supporting bar elements. The supporting bar elements have, at one or both end faces, a form-fit geometry which engages into the form-fit geometry of an adjoining supporting bar element.

In a preferred embodiment of the invention, the form-fit geometry has ribs or projections which preferably run parallel to the movement direction of the sieve belt. This is advantageous because the critical height of the wearing elements of supporting bar elements which adjoin one another is thus exactly defined.

The object according to the invention is furthermore achieved by a kit having the features of the independent kit claim. The kit contains at least two scraper bars according to independent scraper bar claim, The scraper bars are disposed parallel next to one another. A frame having at least two transverse members is disposed transversely under the scraper bars. Two longitudinal members are connected to the transverse members and the two longitudinal members are disposed parallel to the scraper bars and between the two longitudinal members the scraper bars are received.

A kit of this kind has the advantage that the scraper bar elements according to the invention can be assembled to form scraper bars in a simple and exact manner and can be installed, mounted in a frame, into a plant.

In the invention, it is preferable if, in the region of the ends of the scraper bars, sealing elements are arranged between the scraper bars. The sealing elements are used to seal off the edge region of the kit in the direction of the sieve belt, so that a vacuum can be established.

In a further preferred embodiment of the invention, the sealing elements have two tensioning elements which are arranged in succession in the direction of the longitudinal extent and which bear against one another at oblique surfaces which are oriented at an angle not equal to 90° with respect to the longitudinal extent. As a result of the pushing together of the tensioning elements, the latter move in relation to one another in a horizontal direction, as a result of which the effective width of the sealing elements increases and the sealing elements are fixed between the scraper bars.

The object of the invention is furthermore achieved by a plant for producing a paper web, having the scraper bars according to the invention and possibly the kit according to the invention.

Other features which are considered as characteristic for the invention are set forth in the appended claims.

Although the invention is illustrated and described herein as embodied in a scraper bar for use in a plant for producing a paper web, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
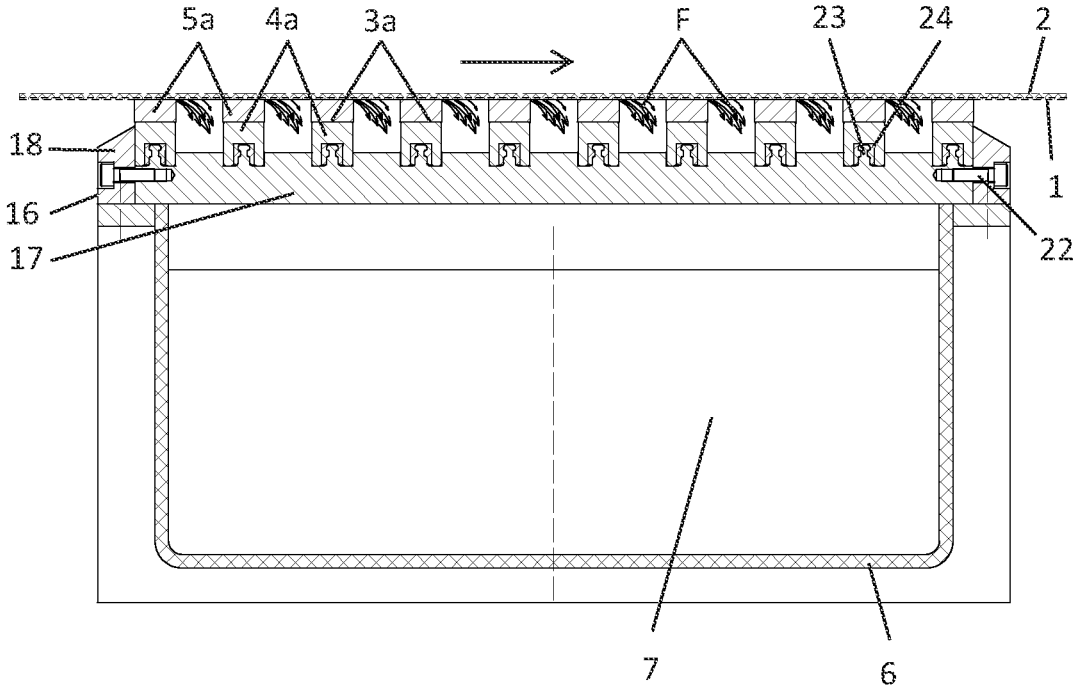
FIG. 1 is a longitudinal sectional view of a portion of a plant for producing a paper web with a sieve belt which is moved over scraper bars and a suction box located thereunder.

Referring now to the figures of the drawings in detail and first, particularly to FIG. 1 thereof, there is shown a portion of a sieve belt 1 in a plant for producing a paper web, the sieve belt having a layer of fibrous stock 2 located on it and being moved over a group of scraper bars 3*a* in the direction of the arrow. The fibrous stock 2 is sprayed onto the sieve belt 1 at the beginning of the sieve belt. The scraper bars 3*a* have a supporting bar 4*a*, wearing elements 5*a* made of a wear-resistant material being fastened to the top side, facing toward the sieve belt 1, of the supporting bar.

An embodiment of the invention as illustrated in FIG. 1 is preferably used in a part of the plant in which the fibrous stock has already been dewatered to a certain extent. A suction box 6, in the interior space 7 of which a negative pressure of approximately −2 mbar to −700 mbar prevails, is therefore located below the scraper bars 3*a*. The negative pressure prevailing in the interior space 7 of the suction box 6 exerts a suction force on the fibrous stock 2 that removes liquid F present in the fibrous stock. The liquid F emerging from the fibrous stock 2 passes through the sieve belt 1 and reaches the underside of the sieve belt 1, during the movement of the sieve belt 1 over the scraper bars 3*a* said liquid is scraped off from the underside by the scraper bars and enters the suction box 6 which conducts it away.

In this embodiment of the invention, the scraper bars 3*a* are mounted on a frame 16 which is releasably fastened to the top side of the suction box 6.

Figure 2:
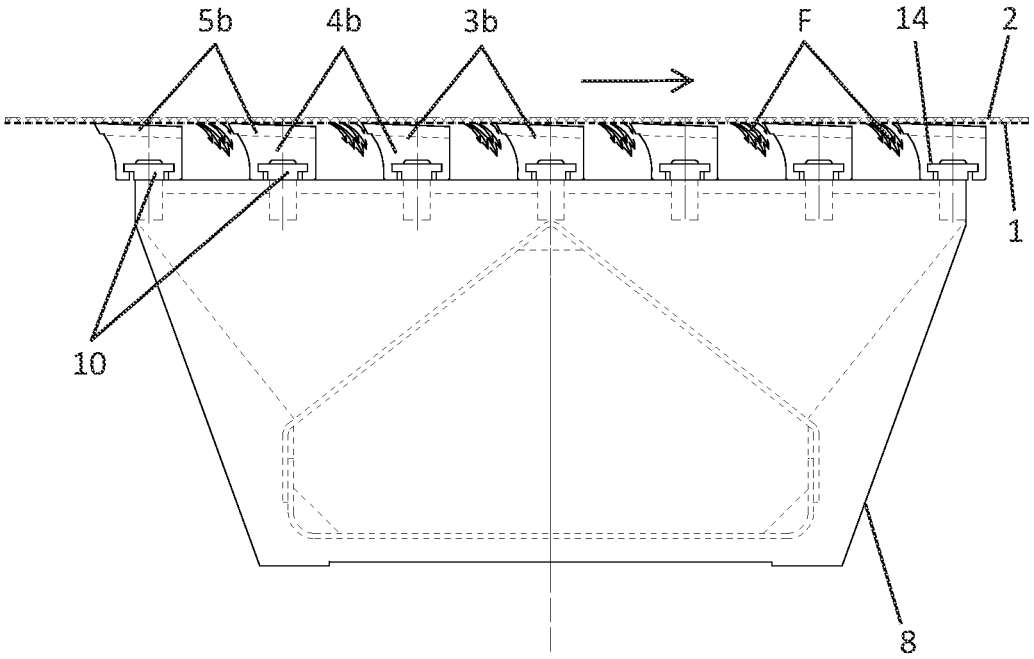
FIG. 2 is a longitudinal sectional view of an alternative embodiment of a portion of a plant for producing a paper web with a sieve belt which is moved over scraper bars and a box located thereunder.

FIG. 2 illustrates an embodiment of the invention with scraper bars 3*b* which is preferably used in a part of the plant in which the fibrous stock 2 still contains a very high proportion of liquid F which passes, even without negative pressure, through the sieve belt 1 to the underside thereof and can be scraped off by the scraper bars 3*b*. Instead of the suction box 6 as in the embodiment of FIG. 1, provision is therefore made of a box 8 which serves only to conduct away the scraped-off liquid F.

In the embodiment of the invention illustrated in FIG. 2, the scraper bars 3*b* also have a supporting bar 4*b*, wearing elements 5*b* made of a wear-resistant material being fastened to the top side, facing toward the sieve belt 1, of the supporting bar.

The sieve belt 1, which may extend over a length of up to approximately 50 m and usually has a width of 2 m up to 12 m, is moved over the scraper bars 3*a*, 3*b* at a speed of e.g. 1 m/sec to 40 m/sec by means of conveyor rolls located in the plant.

During the movement of the sieve belt 1 over the scraper bars 3*a*, 3*b*, during which the sieve belt 1 slides over the surface of the wearing elements 5*a*, 5*b* of the scraper bars 3*a*, 3*b*, high friction resistances occur which have to be overcome by the conveyor rolls located in the sieve belt plant in order to move the sieve belt 1. This also causes high wear of the sieve belt 1 and of the wearing elements 5*a*, 5*b*, as a result of which the sieve belt 1 has short service lives and the scraper bars 3*a*, 3*b* have limited service lives.

The supporting bars 4*a*, 4*b* are usually, but not necessarily, produced from a glass-fiber-reinforced plastic, from acid-resistant high-grade steel or from a plastic such as polyethylene. The suction box 6 of the embodiment of FIG. 1 and the box 8 of the embodiment of FIG. 2 are generally also produced from acid-resistant high-grade steel.

The wearing elements 5*a*, 5*b* located on the supporting bars 4*a*, 4*b* are preferably plates made of a ceramic material, e.g. Al oxide (hardness HV 0.5 18 000 N/mm2), Zr oxide (hardness HV 0.5 12 700 N/mm2), Si nitride (hardness HV 0.5 18 800 N/mm2), Si carbide (hardness HV 0.5 28 150 N/mm2). The ceramic plates have, in the longitudinal extent of the scraper bars 3*a*, 3*b*, a length of for example 12 mm to 230 mm and, transversely with respect to the scraper bars 3*a*, 3*b*, a width of for example 12 mm to 100 mm, and also a height of for example 2 mm to 10 mm. In order to keep friction resistances that occur during the movement of a sieve belt 1 over the scraper bars 3*a*, 3*b* as low as possible, the surfaces of the scraper bars 3*a*, 3*b*, in particular of the ceramic plates 5*a*, 5*b*, are surface-ground according to the prior art, wherein they have surface roughness values Ra of 0.15 μm to 0.7 μm.

Figure 3:
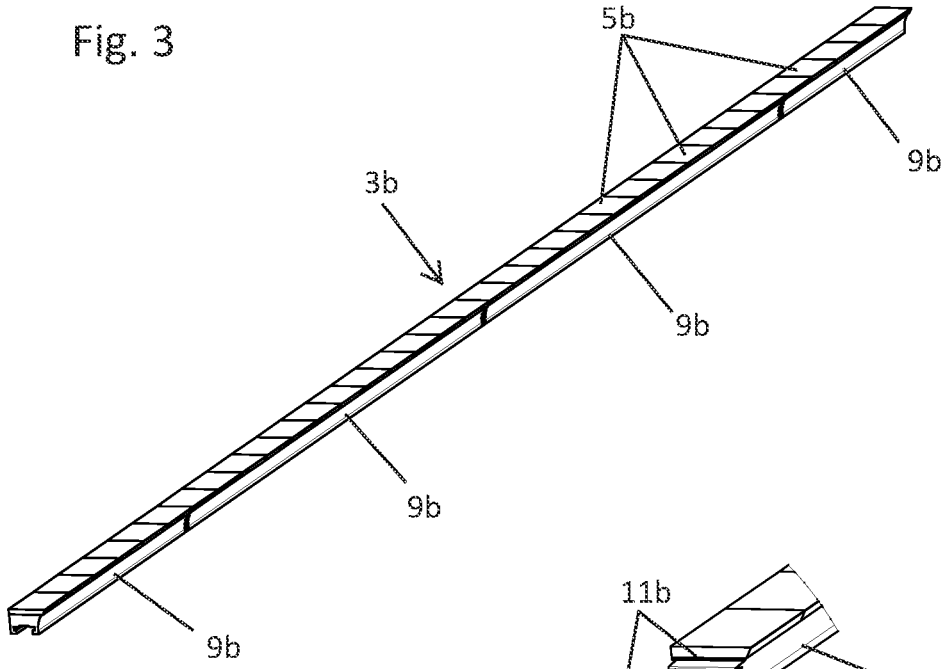
FIG. 3 is a diagrammatic, perspective view of a first embodiment of a scraper bar according to the invention, as is used in the embodiment of FIG. 2.

FIG. 3 illustrates a first embodiment of a scraper bar 3*b* according to the invention which is composed of supporting bar elements 9*b*, wherein the scraper bar 3*b* in the embodiment illustrated has four supporting bar elements 9*b*. The two central supporting bar elements 9*b* have a length of for example 2 m and the two outer supporting bar elements 9*b* have a length of for example 1 m.

Figure 4:
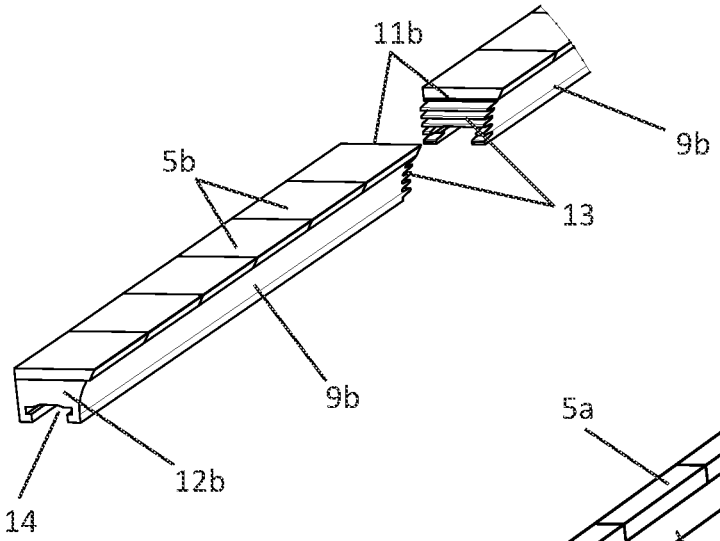
FIG. 4 is a perspective view of a supporting bar element of the embodiment of FIG. 3 on an enlarged scale.

In FIG. 4, the supporting bar element 9*b* which is arranged on the far left in FIG. 3 is illustrated in greater detail with the supporting bar element 9*b* which adjoins it. In the longitudinal extent of the scraper bar 3*b*, a plurality of wearing elements 5*b* are fastened and adhesively bonded to the top side of the supporting bar element 9*b*, the top side facing toward the sieve belt 1, for example by means of form-fit elements (not illustrated). It is also possible, but likewise not illustrated in the drawings, for two, and if required also more than two, wearing elements to also be present transversely with respect to the longitudinal extent.

The supporting bar elements 9*b* each have two end faces 11*b*, 12*b*. The central supporting bar elements 9*a* have two end faces 11*b* which have, as can be seen in FIG. 4, a form-fit geometry 13 which corresponds to the form-fit geometry 13 of the end face 11*b* of an adjoining supporting bar element 9*b*. In the embodiment illustrated, the form-fit geometry consists of ribs or projections which are oriented horizontally, that is to say parallel to the wearing elements 5*b*, such that joined-together supporting bar elements 9*b* engage in one another in a tooth-like manner by way of their form-fit geometries 13. This ensures that the top side of the wearing elements 5*b* of supporting bar elements 9*b* which adjoin one another is exactly aligned in terms of its height. It would of course also be possible to embody the form-fit geometry 13 such that an exactly aligned orientation of the supporting bar elements 9*b*, together with the wearing elements 5*b* fastened thereon, is also provided in the horizontal direction, but this is less critical.

The supporting bar elements 9*b* are preferably adhesively bonded to one another at their end faces 11*b*, before they are installed into a plant. As an alternative, the supporting bar elements 9*b* may also be adhesively bonded to one another in the course of the installation. However, adhesive bonding is of course not absolutely necessary.

As can be seen in particular in FIG. 4, a supporting bar element 9*b* arranged at the end of a scraper bar 3*b* may also have a smooth end face 12*b*, because it does not have to form a form fit with any adjacent supporting bar elements 9*b*.

On their underside, that is to say the side opposite the wearing elements 5*b*, the supporting bar elements 9*b* have a recess 14 which runs in the direction of their longitudinal extent and which has a T-shaped geometry in the embodiment illustrated. Corresponding T-shaped bars 10, onto which the supporting bar elements 9*b* are pushed, are fastened to the box 8.

Figure 5:
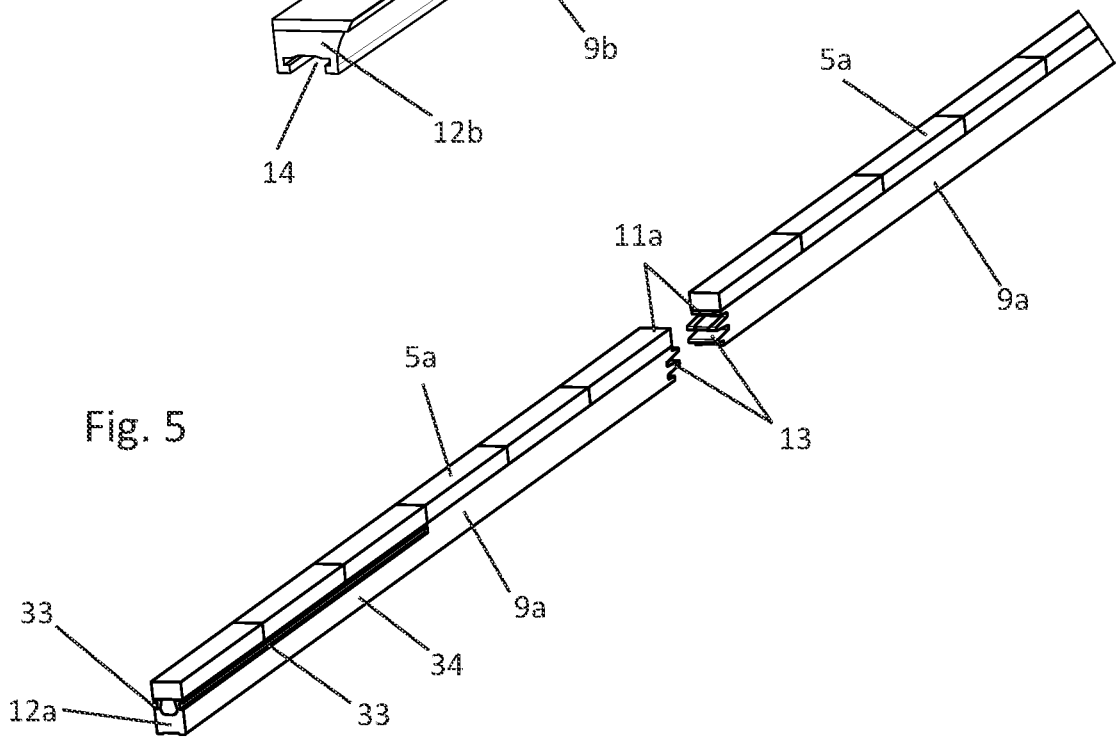
FIG. 5 is a perspective view of a second embodiment of a scraper bar according to the invention, as is used in the embodiment of FIG. 1.
Figure 6:
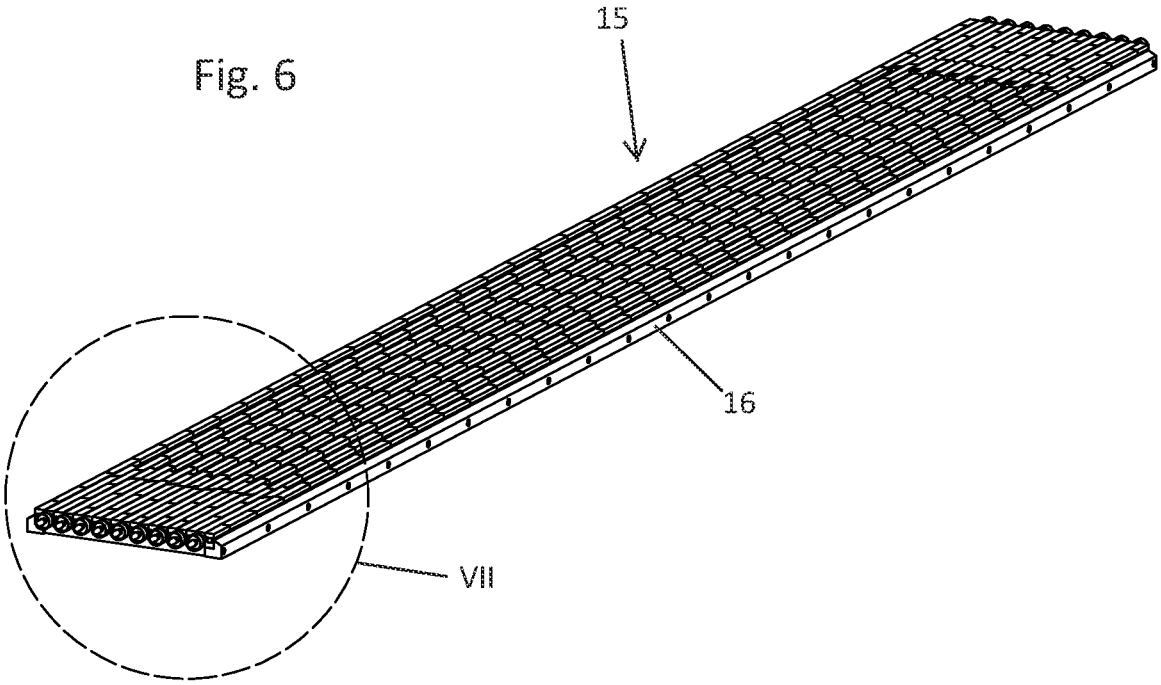
FIG. 6 is a perspective view of a kit according to the invention in the assembled state.
Figure 7:
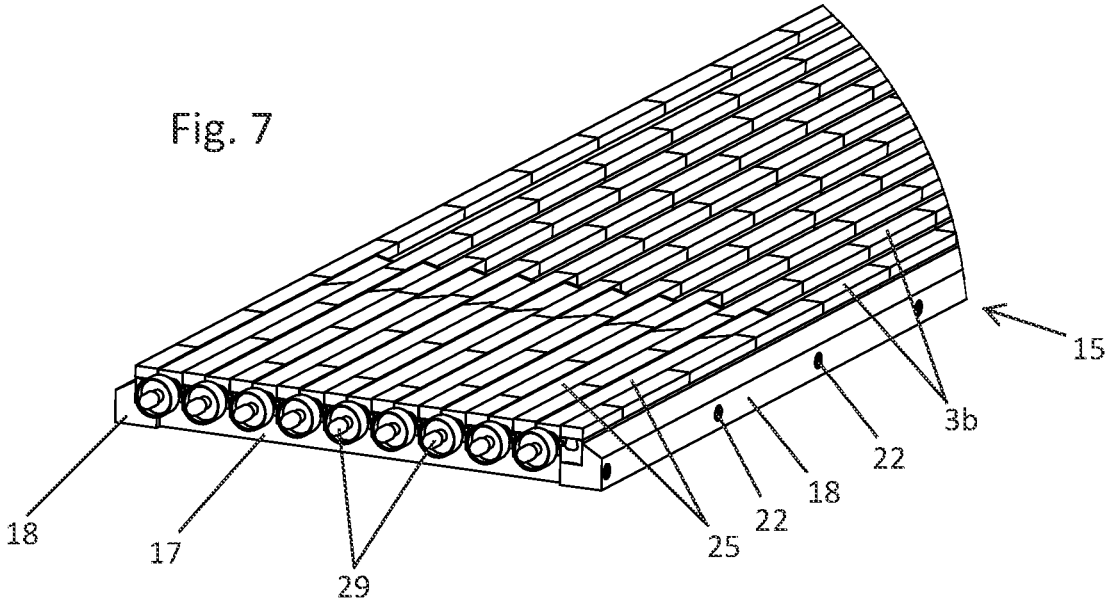
FIG. 7 is a perspective view of an end of the kit of FIG. 6 on an enlarged scale.
Figure 8:
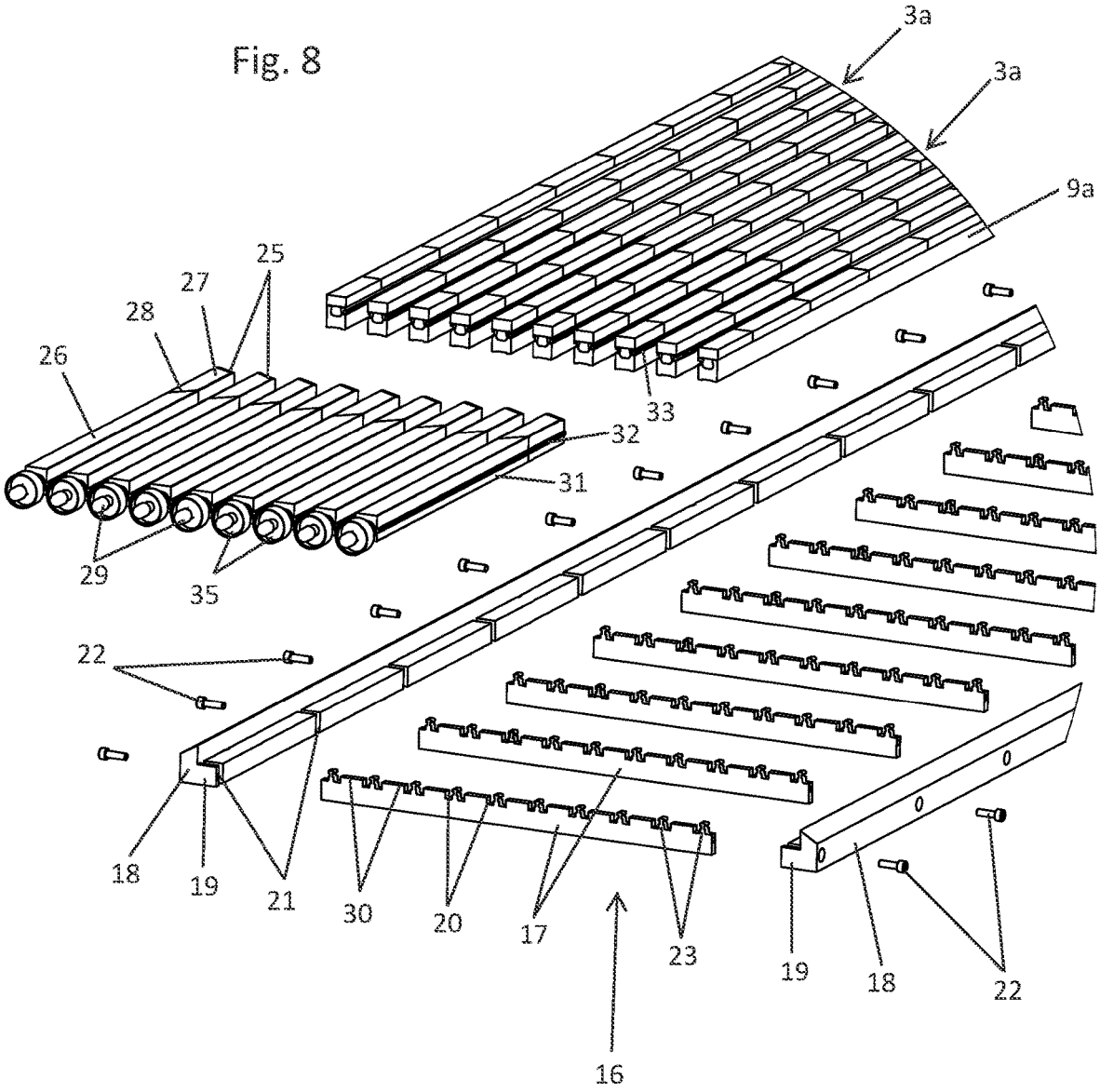
FIG. 8 is an exploded, perspective view of the end of the kit of FIG. 7.

FIG. 5 illustrates a second embodiment of supporting bar elements 9*a*, which is similar to the embodiment of FIGS. 2 and 3 and, in the embodiment of FIG. 1, is preferably, but not necessarily, used in conjunction with a kit 15 according to the invention, as will be described below with reference to FIGS. 6 to 8.

Unless described otherwise below, the comments made with respect to the embodiment of the scraper bar 3*b* of FIGS. 3 and 4 fundamentally also apply to the scraper bar 3*a* of FIGS. 5 to 8, and vice versa.

The kit 15 has a frame 16 which is composed of transverse members 17 and longitudinal members 18 and in which a plurality of scraper bars 3*a* are mounted. The longitudinal members 18 have a substantially L-shaped geometry, wherein cutouts in the form of slots 21 are made in a substantially horizontally oriented limb 19 of the longitudinal member 18. Received in these slots 21 are the ends of the transverse members 17, which are flat in the embodiment illustrated, such that they are fixed in the longitudinal direction of the longitudinal members 18. In addition, the transverse members 17 are fixed to the longitudinal members 18 by means of screws 22 which are screwed through the longitudinal members 18 into the end faces of the transverse members 17.

The scraper bars 3*a* can be inserted into the stable frame 16 thus produced. The distance of the transverse members 17 from one another is, on the one hand, dependent on the length of the supporting bar elements 9*a* and is selected such that each supporting bar element 9*a* rests on at least two transverse members 17. On the other hand, the distance of the transverse members 17 is determined by the expected loading by the negative pressure in the suction box 6.

At their top edge, the transverse members 17 have cutouts 20, in the center of which there are pins 23. The supporting bar elements 9*a* have holes 24 on their underside. In the installed state, the scraper bars 3*a* sit in the cutouts 20 of the transverse members 17 and the pins 23 of the transverse members 17 project into the holes 24 of the supporting bar elements 9*a*. The supporting bar elements 9*a* are fastened to the transverse member 17 by filling the holes 24 with adhesive.

Between the cutouts 20, wider, flat webs 30 which serve as supports for sealing elements 25 are located on the transverse members 17. These sealing elements 25 are arranged on both sides between the end-face ends of the scraper bars 3*a*. In the embodiment illustrated, the sealing elements 25 consist of in each case two tensioning elements 26, 27 which bear against one another at oblique surfaces 28 which are oriented at an angle $\alpha$ not equal to 90°, preferably between 45° and 60°, with respect to the longitudinal extent of the scraper bars 3*a*.

The tensioning elements 26, 27 are pulled toward one another by a tensioning screw 29 which is guided through a through-hole in the one tensioning element 26 and is screwed into the other tensioning element 27. It would of course also be possible to provide through-holes in both tensioning elements 26, 27 and to tighten the tensioning screw 29 with a nut. Due to the tightening of the tensioning screw 29, the tensioning elements 26 slide on one another along the oblique surfaces 28, as a result of which the effective total width of the sealing element 25 increases and the sealing element 25 is fixed between the scraper bars 3*a* or their end-side supporting bar elements 9*a*.

Arranged on both sides 31 of the tensioning elements 26, 27 are tongues 32 which engage into grooves 33 on both sides 34 of the supporting bar elements 9*a* so that the tensioning elements 26, 27 are secured in their correct position.

The following is a summary list of reference numerals and the corresponding structure used in the above description of the invention:

1 Sieve belt
2 Fibrous stock
3*a*, 3*b* Scraper bars
4*a*, 4*b* Supporting bars
5*a*, 5*b* Wearing elements
6 Suction box

7 Interior space
8 Box
9*a*, 9*b* Supporting bar elements
10 T-shaped bars
11*a*, 11*b* End faces
12*a*, 12*b* End faces
13 Form-fit geometry
14 T-shaped recesses
15 Kit
16 Frame
17 Transverse member
18 Longitudinal member
19 Limb
20 Cutouts
21 Slots
22 Screws
23 Pins
24 Holes
25 Sealing elements
26 Tensioning elements
27 Tensioning elements
28 Oblique surfaces
29 Tensioning screws
30 Webs
31 Sides of the tensioning elements
32 Tongues
33 Grooves
34 Sides of the supporting bar elements
F Liquid

The invention claimed is:

1. A scraper bar for use in a plant for producing a paper web with a sieve belt, the scraper bar comprising:

a scraper body having a longitudinal extent and the sieve belt is movable over said scraper body transversely with respect to the longitudinal extent, said scraper body having a supporting bar and wearing elements disposed above said supporting bar, said wearing elements facing toward the sieve belt and disposed one after another in a direction of the longitudinal extent of said scraper body, said supporting bar having supporting bar elements disposed one after another in the direction of the longitudinal extent and are connected to one another, and said wearing elements are fastened on said support bar elements; and said supporting bar elements having end faces at which they bear against adjacent ones of said supporting bar elements, said supporting bar elements each having at, at least one end face of said end faces, a form-fit geometry which engages into said form-fit geometry of an adjoining one of said supporting bar elements, said form-fit geometry having ribs or projections being oriented horizontally, and parallel to said wearing elements, such that joined together said supporting bar elements engage in one another in a tooth-shaped manner by way of said form-fit geometry of each of said supporting bar elements, wherein said form-fit geometry ensures that top sides of adjoining ones of said wearing elements supported by said supporting bar elements are exactly aligned with each other in their respective heights.

2. The scraper bar according to claim 1, wherein said wearing elements are ceramic plates.

3. The scraper bar according to claim 1, wherein said wearing elements each have a length measured in the direction of the longitudinal extent that corresponds to a length of a respective one of said supporting bar elements.

4. The scraper bar according to claim 1, wherein at least two of said wearing elements are disposed one after another in the direction of the longitudinal extent on one of said supporting bar elements.

5. The scraper bar according to claim 1, wherein said supporting bar elements are adhesively bonded to one another at their end faces.

6. The scraper bar according to claim 1, wherein said form-fit geometry has only said projections which run parallel to a movement direction of the sieve belt.

7. The scraper bar according to claim 1, wherein said supporting bar elements have, on their side opposite said wearing elements, a recess formed therein which runs in the direction of the longitudinal extent.

8. The scraper bar according to claim 7, wherein said recess has a T-shaped or trapezoidal shaped cross section.

9. A kit for use in a plant for producing a paper web with a sieve belt, the kit comprising:

at least two scraper bars according to claim 1, said scraper bars disposed parallel next to one another;

a frame having at least two transverse members disposed transversely under said scraper bars; and two longitudinal members connected to said transverse members and said two longitudinal members are disposed parallel to said scraper bars and between said two longitudinal members said scraper bars are received.

10. The kit according to claim 9, wherein said longitudinal members have cutouts formed therein and said transverse members have ends being received in said cutouts.

11. The kit according to claim 10, further comprising pins disposed in said cutouts in said transverse members; and wherein said supporting bar elements have holes formed therein and said pins cooperating with said holes.

12. The kit according to claim 9, further comprising sealing elements, wherein in a region of ends of said scraper bars, said sealing elements are disposed between said scraper bars.

13. The kit according to claim 12, wherein said sealing elements have two tensioning elements which are disposed in succession in the direction of the longitudinal extent and which bear against one another at oblique surfaces which are oriented at an angle not equal to 90° with respect to the longitudinal extent.

14. The kit according to claim 13, further comprising a tensioning screw, said tensioning elements are braced against one another by means of said tensioning screw.

15. The kit according to claim 13, wherein:

at least one of said supporting bar elements has a groove formed therein or a tongue; and at least one of said tensioning elements has a tongue or a groove formed therein which runs in the direction of the longitudinal extent and which engages with said groove or said tongue of an adjoining one of said supporting bar elements.

16. A plant for producing a paper web, the plant comprising:

a sieve belt;

scraper bars, wherein said sieve belt is movable transversely over said scraper bars, said scraper bars have supporting bars and wearing elements disposed above said supporting bars, said wearing elements face toward said sieve belt and are disposed one after another in a direction of a longitudinal extent of said scraper bars, each of said supporting bars having supporting bar elements disposed one after another in the direction of the longitudinal extent and are connected to one another, and said wearing elements are fastened on said support bar elements; and said supporting bar elements having end faces at which they bear against adjacent ones of said supporting bar elements, said supporting bar elements each having at, at least one end face of said end faces, a form-fit geometry which engages into said form-fit geometry of an adjoining one of said supporting bar elements, said form-fit geometry having ribs or projections being oriented horizontally, and parallel to said wearing elements, such that joined together said supporting bar elements engage in one another in a tooth-shaped manner by way of said form-fit geometry of each of said supporting bar elements, wherein said form-fit geometry ensures that top sides of adjoining ones of said wearing elements supported by said supporting bar elements are exactly aligned with each other in their respective heights.

17. A plant for producing a paper web, the plant comprising:

a sieve belt;

at least two scraper bars, said sieve belt being movable transversely over said scraper bars, and said scraper bars each have a supporting bar and wearing elements disposed above said supporting bars, said wearing elements facing toward said sieve belt and disposed one after another in a direction of a longitudinal extent of a respective one of said scraper bars, wherein said supporting bar has supporting bar elements disposed one after another in the direction of the longitudinal extent and are connected to one another, and said wearing elements are fastened on said support bar elements;

said supporting bar elements having end faces at which they bear against adjacent ones of said supporting bar elements, said supporting bar elements each having at, at least one end face of said end faces, a form-fit geometry which engages into said form-fit geometry of an adjoining one of said supporting bar elements, said form-fit geometry having ribs or projections being oriented horizontally, and parallel to said wearing elements, such that joined together said supporting bar elements engage in one another in a tooth-shaped manner by way of said form-fit geometry of each of said supporting bar elements, wherein said form-fit geometry ensures that top sides of adjoining ones of said wearing elements supported by said supporting bar elements are exactly aligned with each other in their respective heights;

a kit having said at least two scraper bars, said scraper bars disposed parallel next to one another;

a frame having at least two transverse members disposed transversely under said scraper bars; and two longitudinal members connected to said transverse members and being disposed parallel to said scraper bars and between said longitudinal members said scraper bars are received.

* * * * *